US006244239B1

(12) United States Patent
Sisco et al.

(10) Patent No.: US 6,244,239 B1
(45) Date of Patent: Jun. 12, 2001

(54) INTEGRATED FRONT END ACCESSORY DRIVE SYSTEM

(75) Inventors: William C. Sisco, Homer; Steve J. Chevalier, Britton, both of MI (US)

(73) Assignee: Simpson Industries, Plymouth, MI (US)

( * ) Notice: Subject to any disclaimer, the term of this patent is extended or adjusted under 35 U.S.C. 154(b) by 0 days.

(21) Appl. No.: 09/195,122

(22) Filed: Nov. 18, 1998

Related U.S. Application Data

(60) Provisional application No. 60/066,132, filed on Nov. 19, 1997.

(51) Int. Cl.[7] ..... F02F 7/00; F02B 77/14

(52) U.S. Cl. ..... 123/198 R; 123/195 A; 123/192.1

(58) Field of Search ..... 123/198 R, 198 C, 123/192.1, 41.44, 195 A, 195 C

(56) References Cited

U.S. PATENT DOCUMENTS

| | | | | |
|---|---|---|---|---|
| 1,647,434 | | 11/1927 | Chorlton . | |
| 2,875,746 | | 3/1959 | Brice . | |
| 3,730,147 | | 5/1973 | Buchwald . | |
| 4,307,583 | | 12/1981 | Hall . | |
| 4,321,896 | | 3/1982 | Kasting . | |
| 4,502,345 | | 3/1985 | Butterfield . | |
| 4,573,439 | | 3/1986 | Kasting . | |
| 4,598,677 | | 7/1986 | Mongin . | |
| 4,697,782 | | 10/1987 | Ban . | |
| 4,977,870 | * | 12/1990 | Hashimoto et al. | 123/195 C |
| 5,010,855 | * | 4/1991 | Ogami et al. | 123/90.31 |
| 5,048,478 | | 9/1991 | Bonde . | |
| 5,065,713 | | 11/1991 | Seats . | |
| 5,125,376 | | 6/1992 | Williams . | |
| 5,129,375 | | 7/1992 | Takane . | |
| 5,203,293 | * | 4/1993 | Shintani et al. | 123/195 A |
| 5,247,845 | | 9/1993 | Grayson . | |
| 5,314,319 | | 5/1994 | Nilsson . | |
| 5,692,466 | * | 12/1997 | Hausmann et al. | 123/195 A |
| 5,704,329 | * | 1/1998 | Bublitz et al. | 123/195 A |
| 5,718,196 | * | 2/1998 | Uchiyama et al. | 123/195 C |
| 5,938,169 | * | 8/1999 | Ogawa et al. | 248/674 |

FOREIGN PATENT DOCUMENTS

| | | |
|---|---|---|
| 28 54 992 | 7/1980 | (DE) . |
| 2069595A | 8/1981 | (GB) . |

* cited by examiner

*Primary Examiner*—Noah P. Kamen
*Assistant Examiner*—Hai Huynh
(74) *Attorney, Agent, or Firm*—Artz & Artz, P.C.

(57) ABSTRACT

A system for integrating together all the engine driven accessories on a typical automotive engine such that all the basic engine auxiliaries and secondary chassis related accessories are mounted in a compact and rigid assembly. The driving means for the secondary accessories is typically but not restricted to a single Multi-rib V belt driven by a pulley or torsional damper mounted to the front extension of the crankshaft. The auxiliaries and accessories are built into or mounted rigidly to an integrated housing. The integrated housing is mounted to a single surface of the engine block giving the strength and rigidity needed to carry the loads and offering the best accuracy for the location of the accessories to the crankshaft and to each other for best belt life and minimum noise from the belt and pulleys and engine forcing frequencies. The single housing also offers the ability to allow pre-assembly of the whole front end assembly drive (FEAD) package for the subsequent modular assembly to the rest of the engine.

15 Claims, 4 Drawing Sheets

INTEGRATED FRONT END ACCESSORY DRIVE SYSTEM

CROSS-REFERENCE TO RELATED APPLICATIONS

This application claims priority to applicant's now abandoned U.S. provisional application, Serial No. 60/066,132 filed on Nov. 19, 1997.

TECHNICAL FIELD

The present invention relates to an accessory drive system for an engine, and more particularly to a front-end accessory drive system that integrates a plurality of engine drive accessories on a single housing for one-piece assembly to a vehicle engine.

BACKGROUND ART

It has been common practice in the automotive industry to mount the various engine drive accessories, such as the generator/alternator, power steering pump, air conditioning compressor, engine water pump, exhaust air pump, etc. to the front of the engine with a variety of separate brackets. This practice allowed the position of the accessories to be varied in order to fit different applications. It also allowed the position of the accessories to be adjusted in order to tension the drive belt. Individually mounted accessories also allowed different accessory combinations or "packages" to be mounted on a particular engine, such as may be necessary depending upon the different options ordered with a given vehicle. With these accessory packages, many of the accessories were typically mounted to different surfaces of the engine. This resulted in many of the accessories lying in different planes and thus required the utilization of multiple belts.

It has also been known to mount the engine drive accessories in one or more parallel planes allowing them to be driven with a plurality of V belts from a crankshaft pulley. This configuration provided a reliable, quiet, efficient and economical power transmission system, but still suffered from various problems, including the fact that the accessories were mounted to engine surfaces that were positioned in different planes. Instead of multiple belts, a single serpentine multi-rib V belt has also been utilized to drive all the accessories that were positioned in a single plane by utilizing both sides of the belt.

Regardless of the number of belts used, controlling belt tension in order to reduce wear thereon is a significant design concern. Belt tension has typically been controlled with a spring loaded pulley for automatic continuous adjustment of tension as well as to take-up any slack from belt stretch or wear in the system. These arrangements compensate for belt wear and help to prolong belt life, which is a significant concern for automotive manufacturers who want to warrant belt life for 100,000 miles or more. However, other significant factors also contribute to belt wear, including mounting tolerances and pulley alignment.

Therefore, a large amount of development effort has gone into refining these belt drive systems to make them more durable, quiet, and efficient. However, many problems remain. Developing solutions to these problems has been made more challenging by the demands for drive belt systems having higher durability that also have quieter operating levels.

Two primary problems still exist with current vehicle belt drive systems. The first primary problem is the need for accurate alignment of the drive accessories, each having their own belt pulleys, to provide optimum belt operating conditions. The second primary problem is to provide rigid mounting of the drive accessories so that the system as a whole is free from noise, vibration, and harshness ("NVH") in the form of troublesome resonant vibrations.

Regarding the first problem, the alignment of the belt pulleys is influenced by a variety of factors, including the number of drive components incorporated in a given system, their dimensions and the number of surfaces to which the components are attached. Each of these components have separate tolerances. Thus, as the number of components and different surfaces to which the components are attached increases, the tolerances add up to higher than desired amounts. These added tolerances make it more difficult to align the drive accessories in one plane and also increases the manufacturing and assembly costs if one attempts to align the drive accessories in one plane through tighter tolerances.

Additionally, traditional mounting brackets have been made with materials and processes such as stampings and castings that also have large tolerances. Machining the mating surfaces can help reduce the tolerances, but this still does not reduce the number of separate interfaces. Further, the surfaces on the engine used for mounting the brackets, such as the cylinder head and the engine block, also have tolerances relative to each other which add to the total variation in pulley alignment, which also affects the NVH quality of the system.

Regarding the second problem, the mounting bracket systems that attach the accessories to the engine also require a certain stiffness to prevent resonant vibration response of the accessories to forcing frequencies from the engine or the accessories. Typically, modern engine systems can easily have forcing frequencies in the range of 350–390 Hz. It has been difficult to design bracket systems that have response frequencies of this level or above. Many factors contribute to this design difficulty, including accessory spacing requirements to obtain acceptable belt run lengths; multi-piece brackets to accommodate different accessory combinations; space requirements to accommodate hoses, wires and their connections; long stand-off distances to accommodate long components such as the water pump; weight and cost limitations on the bracket structure; mounting methods of the accessories themselves; and the need for tools and serviceability of individual accessories.

SUMMARY OF THE INVENTION

It is an object of the present invention to provide a front end accessory drive system that minimizes resonant vibration response to engine forcing frequencies.

It is an additional object of the present invention to provide a front end accessory drive system that is less expensive to manufacture and easier to assemble than prior accessory drive systems.

It is yet another object of the present invention to provide a front end accessory drive system that reduces the problems associated with the combined accessory tolerances present in current systems, thus providing more accurate alignment of the belt pulleys.

It is a related object of the prevent invention to provide a front end accessory drive system that reduces the wear on the drive belt resulting in longer belt life.

It is still a further object of the present invention to provide an integrated one-piece front end accessory drive system that is mounted to a single surface of an engine.

It is yet a further object of the present invention to provide a method for providing a pre-assembled front-end accessory drive device for easy attachment to the front of a vehicle engine.

It is still another object of the present invention to provide a front and accessory drive system that takes up significantly less space than prior systems.

It is yet an additional object of the present invention to provide a front end accessory drive device having necessary fluid passageways and conduits integrally formed therein.

In accordance with the objects of the present invention, a front end accessory drive system having an integrated housing for mounting to the front of a vehicle engine is provided. The integrated housing has a front surface and a rear surface. The front surface has a plurality of engine drive accessories mounted thereon. These drive accessories preferably include a water pump, an air conditioning pump, a power steering pump, and an alternator which all lie in a single plane. A crankshaft damper is also in communication with an end of the engine crankshaft that passes through the housing. At least one drive belt is routed around the pulleys of engine driven accessories on the front surface of the integrated housing. A belt tensioner is also preferably mounted on the front surface of the integrated housing so that the belt can be pre-tensioned around the engine drive accessories and can automatically compensate for stretch of the drive belt. The integrated housing, including the attached drive accessories and the drive belt is mounted to the front of the vehicle engine by securing the rear surface of the integrated housing to the vehicle engine.

BEST MODE(S) FOR CARRYING OUT THE INVENTION

Figure 1:
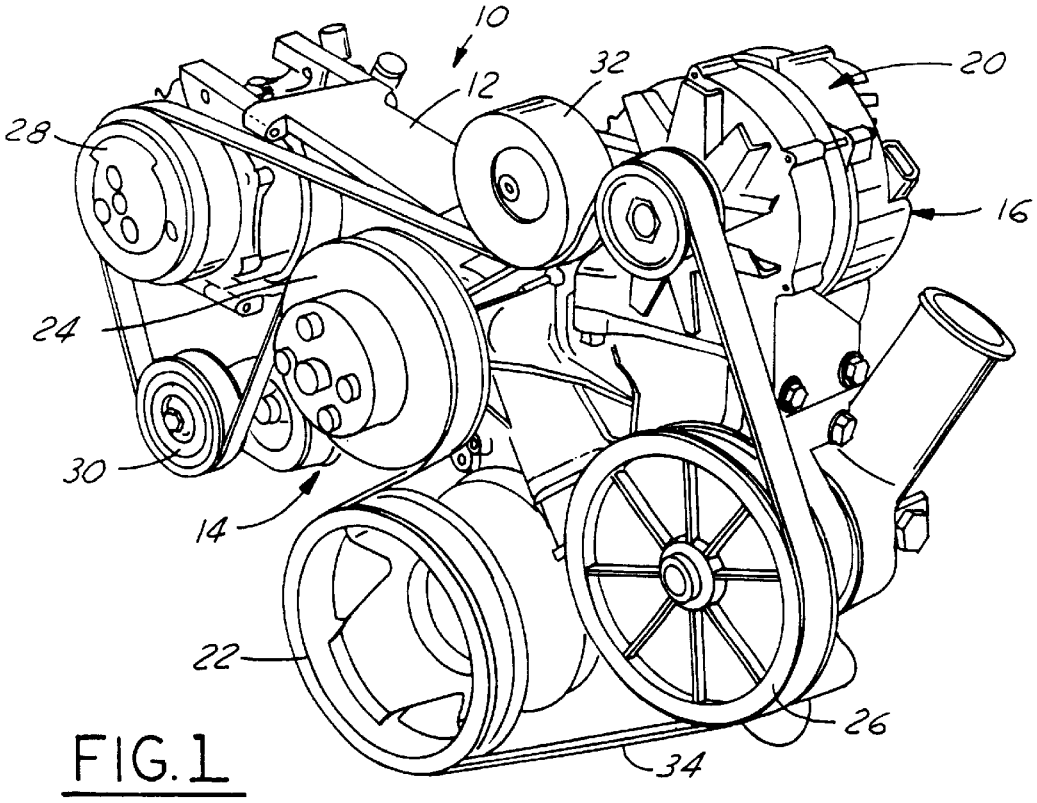
FIG. 1 is a perspective view of a front end accessory drive system with a plurality of engine drive accessories mounted thereon in accordance with a preferred embodiment of the present invention.

FIGS. 1 through 7 illustrate a front end accessory drive system 10 in accordance with a preferred embodiment of the present invention. The preferred front end accessory drive system 10 includes an integrated housing 12, having a front surface 14 and a rear surface 16. The rear surface 16 of the integrated housing 12 is preferably mounted to a vehicle engine 18, as is described in more detail below. The front end accessory drive system 10 may be utilized with any engine, including applications such as vehicle, marine, and stationary.

In the preferred embodiment, the rear surface 16 of the integrated housing 12 is attached to the vehicle engine 18 at a single mounting surface. The mounting surface for attachment of the rear surface 16 to the vehicle engine 18 is preferably the front face 19 of the engine block. However, the integrated housing 12 may alternatively be mounted to other surfaces of the engine or more than one engine surface depending upon the design criteria.

The shape and configuration of the integrated housing 12 depends upon the engine to which it is to be mounted. Accordingly, if the housing 12 were to be utilized with a V6 engine, it would be designed and configured differently than if the housing were to be mounted to a different engine configuration. Therefore, the design of the housing may vary along with the location of the accessories and still achieve the objects of the present invention. It therefore should be understood that the integrated housing 12 shown in the drawings are merely illustrative of an integrated housing 12, in accordance with the present invention.

The integrated housing 12 is preferably constructed of an aluminum alloy. Aluminum is a relatively light, relatively inexpensive material that also provides good strength and damping characteristics. Alternatively, the integrated housing 12 may be constructed of other materials such as laminated steel, stamped steel, or other materials that are less noise emitting. Other factors that may be taken into account when selecting the material, include cost, weight, and noise characteristics. It is also preferable that the material exhibit bearing quality properties. The process for forming the integrated housing 12 may include stamping, casting, or any other method that provides a suitably stiff housing.

The integrated housing 12 preferably has all of the engine drive accessories or components attached to its front surface 14, as is discussed in more detail below. However, depending upon the number of options that are offered with a particular vehicle, it may not be practical to mount all drive accessories to the housing 12. In that case, a predetermined number of accessories will be mounted to the housing 12. It should be understood that the location and number of engine drive accessories may be varied. For example, a vacuum pump, a fuel injection pump, an oil pump, and a cam drive are examples of other engine drive accessories that may be mounted on the integrated housing 12 for incorporation into the front engine drive system 10. The drive accessories are preferably mounted to the integrated housing 12 by bolts or the like at locations along the surface that are tool accessible for easy mounting and also service accessible. The integrated housing 12 is then attached to the front face 19 of the vehicle engine 18.

The integrated housing 12 provides a single structure that incorporates all the attachment points for all the bolted on engine drive accessories. This is unlike prior designs where each individual drive accessory is typically mounted directly to a surface of the vehicle engine 18 with separate brackets. The configuration of the present invention, as described in more detail below, thus minimizes the number of different fasteners in the assembly as well as the total number of fasteners that are used to attach the engine drive accessories to the vehicle engine 18. The elimination of the separate brackets provides the added benefits of minimizing the overall noise level transmitted via acoustics or structure to the passenger compartment of the vehicle, as well as allowing use of common fasteners for securing the integrated housing 12 to the vehicle engine 18. This commonization of fasteners provides a further cost reduction.

Figure 2:
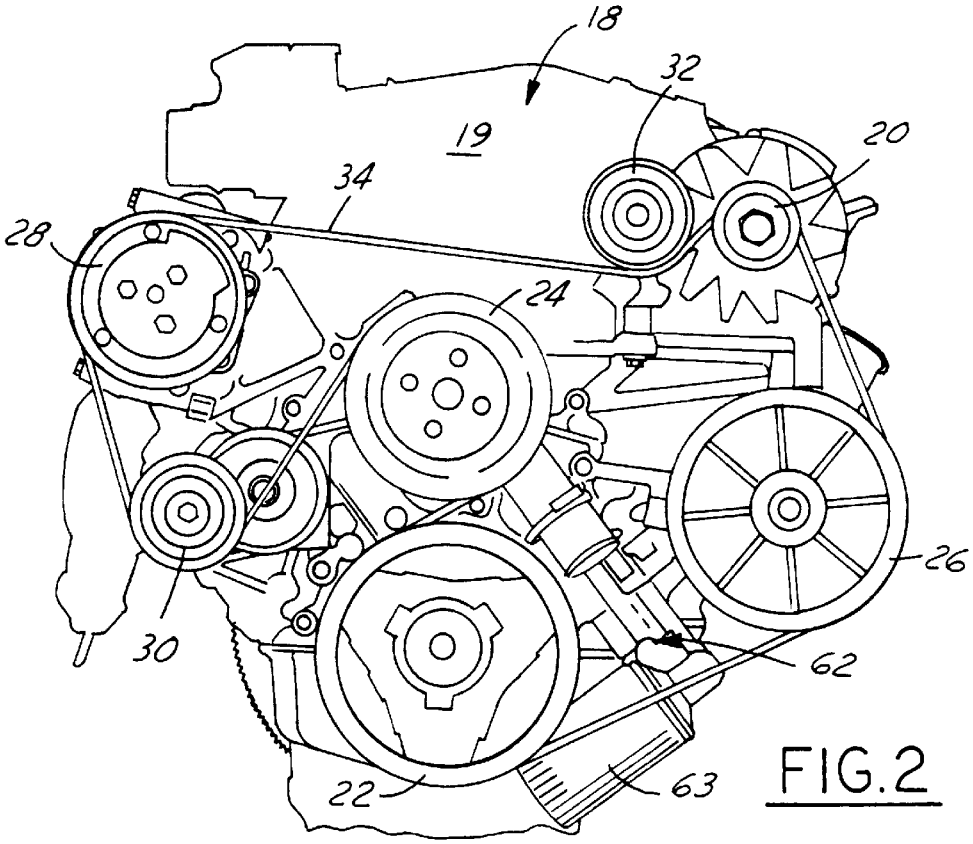
FIG. 2 is a front view of a front end accessory drive system with a plurality of engine drive accessories mounted thereon in accordance with a preferred embodiment of the present invention.
Figure 3:
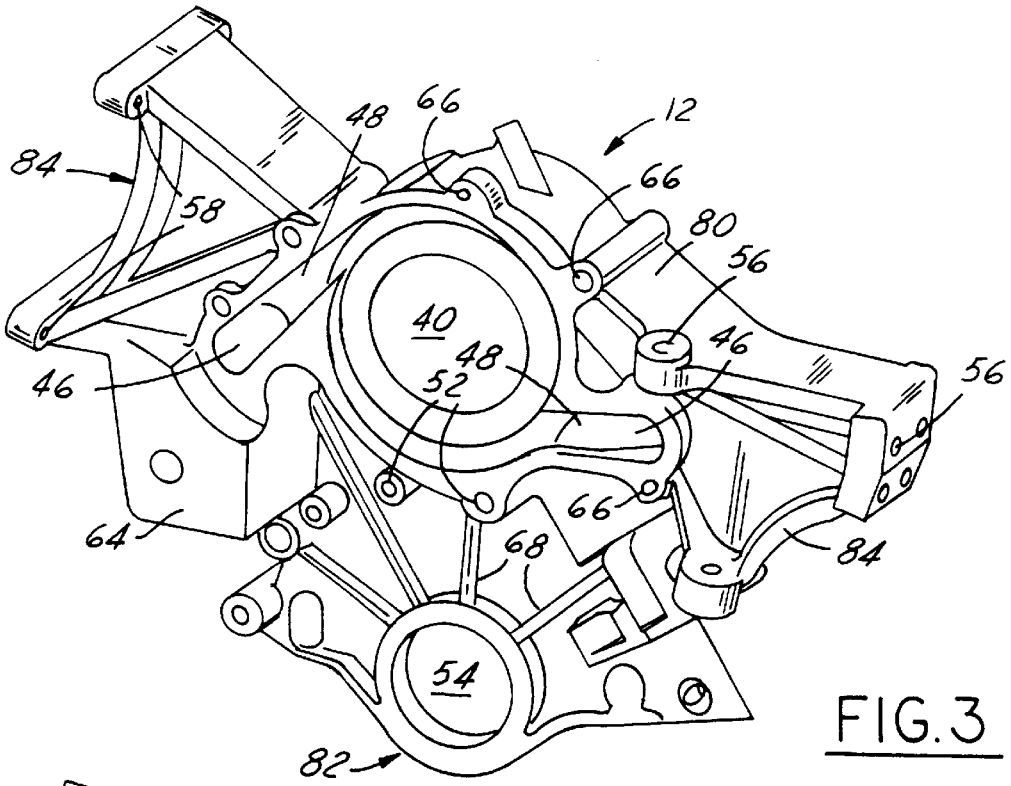
FIG. 3 is a perspective view of an integrated housing for a front end accessory drive system in accordance with a preferred embodiment of the present invention.
Figure 4:
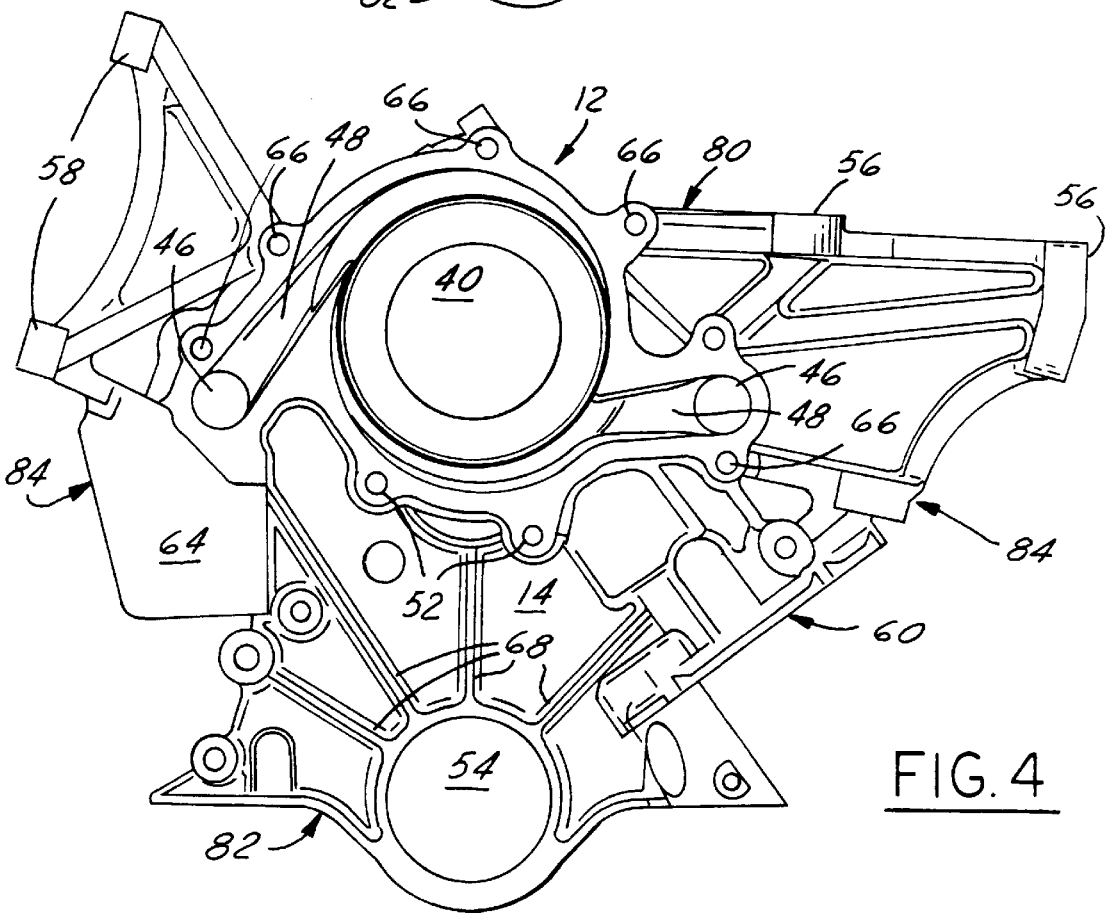
FIG. 4 is a front view of an integrated housing for a front end accessory drive system in accordance with a preferred embodiment of the present invention.
Figure 5:
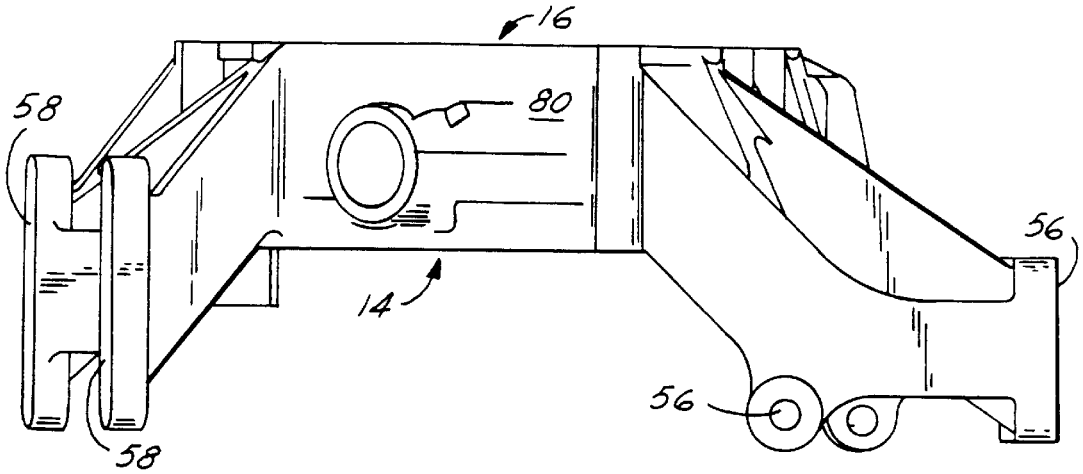
FIG. 5 is a top view of an integrated housing for a front end accessory drive system in accordance with a preferred embodiment of the present invention.
Figure 6:
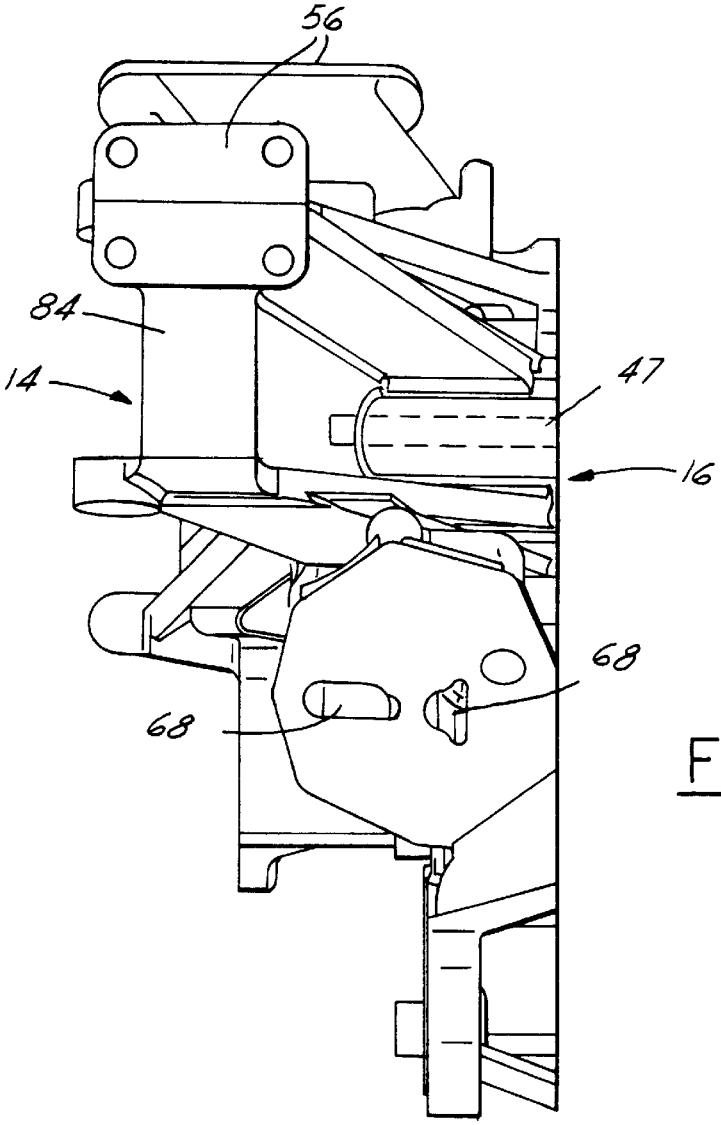
FIG. 6 is a side view of an integrated housing for a front end accessory drive system in accordance with a preferred embodiment of the present invention.

As shown in FIGS. 1 and 2, the integrated housing 12 has a plurality of accessory drive devices mounted thereon for one-piece assembly to a vehicle engine 18. The integrated housing 12 preferably has all the basic engine auxiliaries and secondary application related accessories mounted to its front surface 14. The engine drive auxiliaries include a generator/alternator 20, a water pump 24, a power steering pump 26, and an air conditioning pump or compressor 28. A crankshaft damper 22 is also preferably incorporated into the housing 12 and a belt tensioner 30 and an idler 32 are also preferably attached to the front surface 14 of the integrated housing 12. These components may be any commercially available engine drive components or pumps. However, the preferred crankshaft damper 22 is any commercially available torsional vibration damper used in conjunction with a suitably designed locator bushing.

All of the components except for the crankshaft damper 22 are permanently secured to the integrated housing 12. Since the damper 22 is adapted to be permanently secured to the nose 92 of the crankshaft 90 which protrudes through the front face 19 of the engine block 18, the damper 22 is temporarily held in place in the integrated housing 12 by one or more locator bushings. A bushing 70 is positioned in the passage 54 in the housing 12 and the extended hub 71 of the damper member 22 is positioned in the bushing. The bushing 70 is securely attached or connected to the housing 12, and the damper hub 71 and the bushing is designed to have a close tolerance fit. In this manner, the damper and belt can be assembled on the housing before the housing 12 is assembled on the engine block 18, so that the housing 12 can be installed as one entire unit.

Further details and features of the locator bushing and its use with the present invention are shown and disclosed in co-pending patent application Ser. No. 09/195,338 (File SIMP 0128 PUS), entitled "Engine Module Locator Bushing", filed concurrently with the present application, the disclosure of which is hereby incorporated by reference herein.

The drive accessories are driven by at least one drive belt 34. The drive belt 34 is preferably a multi-rib V-belt. The drive belt 34 is wound around the engine accessories, including the crankshaft damper 22 which is connected to front extension of the engine crankshaft. The crankshaft drives the drive belt 34, which in turn drives the remaining engine drive accessories with which the drive belt 34 is in communication. The belt tensioner 30 automatically adjusts the tension of the drive belt 34 to keep it taut during operation and also prevent wear. The belt tensioner 30 may also assist in preassembling the integrated housing 12. The belt tensioner 30 is therefore adjustable to take up for any slack in the drive belt 34.

Additionally, the idler 32 is positioned adjacent the alternator 20 to provide sufficient belt wrap on the alternator. While only a single belt is shown, it should be understood that multiple belts may be utilized in accordance with the present invention. Additionally, a smaller or larger number of idlers 32 and belt tensioners 30 may be incorporated into the present system. For example, the system may incorporate no belt tensioners 30, if desired.

The integrated housing 12 is shown in FIGS. 3–6 without any engine drive accessories attached. The housing 12 has a top surface 80, a bottom surface 82, and a pair of side surfaces 84 that extend between and connect the front surface 14 and the rear surface 16. As shown in the figures, the front surface 14 of the housing 12 includes a water pump recess 40 formed therein which communicates with the water pump 24. The water pump 24 has a water inlet port 42 (FIG. 7) which receives water transferred thereto from a water hose. Water from the water pump 24 is transferred to the water pump recess 40 which is in communication with a plurality of water exit ports 46 via water exit passageways 48. The water exit ports 46 are formed through the integrated housing 12, while the water exit passageways 48 are formed in the front surface 14 of the integrated housing 12.

The water exit ports 46 are in communication with a respective housing water passage 47 which extends through the integrated housing 12 and opens on the rear surface 16. The housing water passages 47 are in communication with engine block 18 to transfer water from the passages 47 thereto. The integrated housing 12 has a plurality of water pump housing mounts 52 formed through the front surface 14 of the integrated housing 12, to facilitate attachment of the water pump 24 directly to the housing 12. A crankshaft passage 54 is formed through the integrated housing 12.

In the preferred embodiment, a locator bushing 70 is positioned in opening or passageway 54 which provides crankshaft damper alignment with the crankshaft. As stated above, the preferred configuration of the locator bushing is disclosed in the Applicant's concurrently filed patent application entitled "Engine Module Locator Bushing" which is hereby specifically incorporated herein by reference.

The integrated housing 12 has a plurality of alternator mounts 56 formed therein for attachment of the alternator 20 and its housing thereto. The integrated housing 12 also includes a plurality of air conditioning pump mounts 58 for attachment of the air conditioning pump or compressor 28 to the housing 12. The integrated housing 12 also includes a plurality of oil pump mounts 60 to allow attachment to and incorporation of an external oil pump 62 to the integrated housing 12. Preferably, the housing 12 would incorporate an internal oil pump integrated into the structure of the housing.

The integrated housing also includes a belt tensioner mounting pad 64 allowing attachment of the tensioner 30 thereto. The integrated housing 12 also includes a plurality of block mount holes 66 formed through the housing for attachment of the housing 12 to the vehicle engine 18. The block mount holes 66 also allow attachment of the water pump 24 to the housing 12. The mount locations are chosen to maximize the stiffness of the structure and to keep resonant frequencies of the assembled housing 12 higher than the noise driving frequencies of the engine as would be understood by one of skill in the art.

The integrated housing 12 also preferably has a plurality of strengthening ribs 68 formed in the front surface 14. The ribs 68 help minimize the overall noise level transmitted via acoustics or structure to the passenger compartment of the vehicle and otherwise assist in reducing NVH. The ribs 68 may alternatively be formed on other surfaces of the integrated housing 12, including the rear surface 16. Additionally, the design of the integrated housing 12 is such that the various surfaces of the integrated housing 12 lying between the engine drive components are preferably broken up into triangular sections through triangulation, as is well-known in the art. Alternatively, as the shape of the surface of the integrated housing 12 changes, other strengthening methods such as curved or faceted surfaces or other methods for minimizing NVH, may be utilized. The design and configuration of the integrated housing 12 provides stiffness and locates resonant frequencies of the assembled system in the least objectionable places. These assets are accomplished through system design rather than individual component design, as was the case with the prior art.

The configuration of the housing 12 and placement of the drive accessories thereon minimizes the tolerances affecting the angular and linear position and alignment of the belt pulleys and idlers. The inclusion of all the drive accessories 20, 22, 24, 26, 28, 30, 32 in a single plane and mounted to a single structure allows one drive belt 34 to be used to drive the accessories. This configuration also minimizes the tolerance contribution of the individual driven devices and therefore minimizes the wear on the drive belt 34. Further, the integrated housing 12 and the arrangement of the drive accessories thereon and attachment thereto minimizes the spacing of the accessories to allow a shorter drive belt 34 to be used. This can further improve the efficiency of the belt and prolong its life. In the preferred embodiment, a gasket is positioned between the integrated housing 12 and the vehicle engine 18. Additionally, the housing 12 may be formed with a channel or the like to accept a premounted gasket for fluid sealing.

As mentioned above, the integrated housing 12 eliminates the need for a plurality of brackets to separately mount these components to the vehicle engine 18. The integrated housing 12 contains all of the accessories, thus reduces the labor time previously required to mount the plurality of individual brackets. Further, as will be described in greater detail hereinafter, the system 10 is maintenance effective.

Additionally, as shown, the oil pump 62 may be removed from the vehicle engine 18 and mounted to the integrated housing 12 to further integrate the accessory components and decrease the cost to manufacture the system. The oil pump 62 is preferably in communication with the oil passages in the vehicle engine 18 and is mounted to one of the opposing side surfaces 84. The integrated housing 12 has a plurality of oil passages 68 formed therein to allow oil to pass from the oil pump 62 on the housing 12 to the oil filter 63 and then back through the housing 12 to the engine block 18. The preferred integrated housing 12 further incorporates all of the oil pump system components, including relief valves, oil filter mountings, oil cooler mountings, pump supercharging porting and built-in passages and ports necessary for transmission of engine oil to the vehicle engine 18 or other mating accessories.

In an alternative embodiment, an integrated motor mount for a front wheel drive vehicle can be included on the housing 12. This configuration will occur in vehicles where the engine 18 is positioned sideways.

The integrated housing 12 also preferably incorporates all mounting points for necessary sensors, including water temperature sensors, oil temperature sensors, oil pressure sensors, and sensors for ignition timing signals from crank or crankshaft pulse wheels. The preferred integrated housing 12 also accommodates features assisting the assembly of other components such as locator bushings for the crankshaft damper 22 and dowels for precise location of the casings of the alternator, pumps, and tensioners. Features that assist in the assembly of the housing 12 to the block 18, including dowels or matching machined components, may also be utilized.

In the preferred embodiment, the integrated housing 12 is designed so that all components, including accessories and the drive belt 34, may be preassembled so that a total package can be shipped, mated, and fastened to the vehicle engine 18 as a single package. The preferred housing 12 is also designed to minimize the number of manufacturing machinery operations or tooling locations during machining. Such a design allows for minimization of the total cost of material, manufacturing, and assembly of the front end accessory drive system to the engine.

Figure 7:
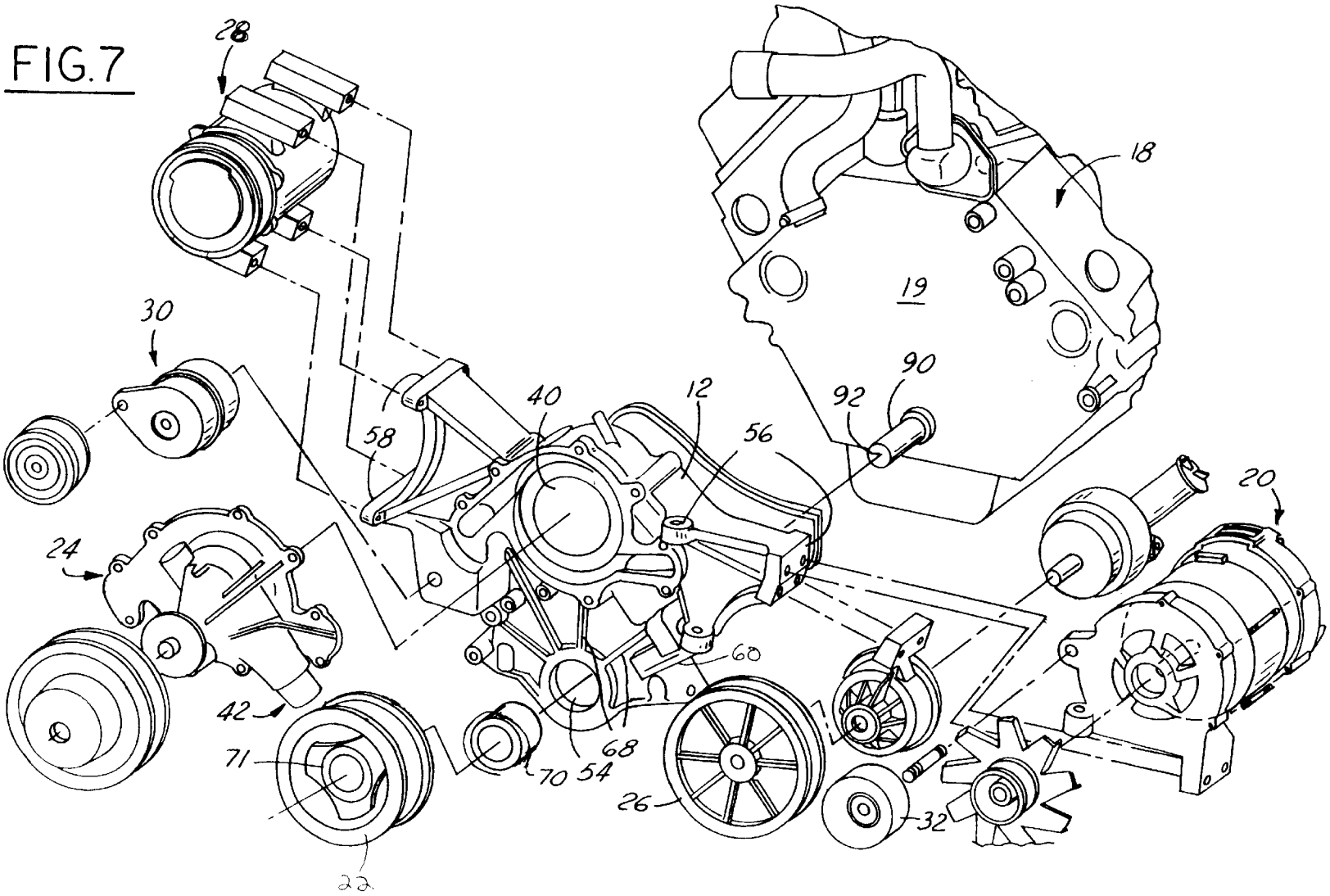
FIG. 7 is an exploded view of a front end accessory drive system in accordance with a preferred embodiment of the present invention.

Referring now to FIG. 7 which is an exploded view of a front-end accessory drive system in accordance with the present invention. In operation, after the integrated housing 12 has been manufactured in its predetermined configuration, each of the drive accessories is then mounted thereto. After the drive accessories have been mounted to the integrated housing 12, the drive belt 34 is then routed or positioned around the various drive accessory pulleys. The belt tensioner 30 is then adjusted and blocked from fully tensioning the belt in its pre-mounted position. After the housing has been mounted to the engine and the damper secured to the crankshaft, the belt tensioner is unblocked to provide full and final tension to the belt.

The integrated housing 12, including all of the accessories and the belt 34 is then bolted through engine block mount holes 66 to the front of vehicle engine 18.

The advantages of the system 10 of the present invention can be illustrated, for example, when compared to a typical stock system for an automotive V-6 engine which resulted in the following savings or reductions:

a) The overall weight of the system was reduced from 21.85 lbs. to 13.45 lbs. or approximately 38%;

b) The length of the drive belt was reduced about 270 mm or about 8%;

c) The stiffness of the housing was increased by about 20%; and d) A savings of about 975 cubic inches of envelope space was realized.

The present invention may be embodied in other specific forms without departing from the spirit or essential attributes thereof; therefore, the illustrated embodiments should be considered in all respects as illustrative and not restrictive, reference being made to the appended claims rather than to the foregoing description to indicate the scope of the invention.

What is claimed is:

1. A front end accessory drive system for reducing engine noise, vibration and harshness, comprising:

an integrated housing having a plurality of engine accessories mounted thereto in a single plane, for attachment to a vehicle engine, said accessories including:
a water pump mounted to said housing;
an air conditioning pump mounted to said housing;
a power steering pump mounted to said housing;
an alternator mounted to said housing;

a crankshaft damper in communication with said housing and in contact with an engine crankshaft, said crankshaft damper lying in said single plane;

a drive belt coupled to said water pump, said air conditioning pump, said power-steering pump, said alternator, and said crankshaft damper; and a belt tensioner for allowing the tightness of said drive belt to be adjusted during assembly.

2. The front end accessory drive system as recited in claim 1, wherein said integrated housing is attached to said vehicle engine at a front surface.

3. The front end accessory drive system as recited in claim 1, further comprising an oil pump mounted to said housing.

4. The front end accessory drive system as recited in claim 1, further comprising a locator bushing to which said crankshaft damper is attached.

5. The front end accessory drive system as recited in claim 1, further comprising at least one water exit passage formed in said housing for transferring water from said water pump to said engine.

6. The front end accessory drive system as recited in claim 1, further comprising at least one oil passage formed in said housing for transferring oil from an oil sump to said oil pump.

7. The front end accessory drive system as recited in claim 6, further comprising a second oil passage formed in said housing for transferring oil from said oil pump to locations that require lubrication.

8. The front end accessory drive system as recited in claim 1, further comprising, at least one mounting point on said housing for communication with accessory sensors.

9. An integrated housing for attachment to a vehicle engine, comprising:

a front surface having a plurality of mount holes for receiving a plurality of engine drive devices;

a rear surface for attachment to said vehicle engine;

a crankshaft passage formed through said housing for communication with an engine crankshaft;

a plurality of fluid passages formed in the housing for transferring fluid from said rear surface to said front surface; and at least one belt tensioner mounted to the housing for assisting in the attachment of said plurality of engine drive devices to the housing whereby a fully accessorized housing can be attached to the vehicle engine.

10. The integrated housing as recited in claim 9, comprising:

a locator bushing in communication with said crankshaft passage to assist in aligning said crankshaft damper to said crankshaft.

11. The integrated housing as recited in claim 9, wherein a water passageway is formed through said housing and in communication with a water pump mounted on said front surface of said housing.

12. The integrated housing as recited in claim 9, wherein an oil passageway is formed through said housing in communication with an oil pump mounted on said front surface of said housing.

13. The integrated housing as recited in claim 9, further comprising:

at least one mounting point on said housing for receipt of a sensor associated with one of said plurality of engine drive devices.

14. The integrated housing as recited in claim 9, further comprising:

a plurality of ribs formed in said housing to minimize the noise level transmitted to a passenger compartment of a vehicle housing said engine.

15. An integrated housing for attachment to a vehicle engine, comprising:

a front surface having a plurality of mount holes for receiving a plurality of engine drive devices, including a crankshaft damper;

a rear surface for attachment to said vehicle engine;

a crankshaft passage formed through said housing for communication with an engine crankshaft for attaching to said crankshaft damper; and a locator bushing in communication with said crankshaft passage to assist in keeping said crankshaft damper positioned with respect to said plurality of engine drive devices.

* * * * *